US006308027B1

(12) United States Patent
Obu et al.

(10) Patent No.: US 6,308,027 B1
(45) Date of Patent: Oct. 23, 2001

(54) IMAGE FORMING APPARATUS HAVING A COMMON SHEET PROCESSING STATION

(75) Inventors: Makoto Obu, Yokohama; Shigeharu Uda, Machida, both of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/604,046

(22) Filed: Jun. 26, 2000

(30) Foreign Application Priority Data

Jun. 24, 1999 (JP) ..... 11-177692
Aug. 16, 1999 (JP) ..... 11-229713
Jun. 9, 2000 (JP) ..... 12-173374

(51) Int. Cl.[7] ..... G03G 15/00
(52) U.S. Cl. ..... 399/110; 399/391; 399/405
(58) Field of Search ..... 399/107, 110, 399/124, 312, 407, 392, 391, 405; 271/9.11, 9.12; 270/1.01

(56) References Cited

U.S. PATENT DOCUMENTS 5,049,946 * 9/1991 Harada ..... 399/110
5,051,760 9/1991 Shoji et al. ..... 347/55
5,081,506 * 1/1992 Borostyan ..... 399/312 X
5,208,612 5/1993 Obu et al. ..... 347/152
5,300,952 4/1994 Wada et al. ..... 347/217
5,379,101 * 1/1995 Takahashi et al. ..... 399/110
5,493,365 2/1996 Matsui et al. ..... 399/1
5,504,590 4/1996 Kawada et al. ..... 358/403
5,512,928 * 4/1996 Kato et al. ..... 399/110 X
5,610,725 3/1997 Kawada et al. ..... 358/403
5,729,809 * 3/1998 Haneda et al. ..... 399/110 X
5,838,456 * 11/1998 Wagi et al. ..... 399/107 X
5,848,329 12/1998 Aoyama et al. ..... 399/113
5,850,581 * 12/1998 Roller ..... 399/107 X
5,881,340 * 3/1999 Stickney et al. ..... 399/110
5,963,755 * 10/1999 Ueda et al. ..... 399/391 X
6,085,051 * 7/2000 Miyasaka et al. ..... 399/110

FOREIGN PATENT DOCUMENTS 58-047732 * 3/1983 (JP) .
58-130355 * 8/1983 (JP) .
04-366695 * 12/1992 (JP) .
06-250455 * 9/1994 (JP) .
10115959 5/1998 (JP) .
11-024512 * 1/1999 (JP) .
11-292313 * 10/1999 (JP) .

* cited by examiner

*Primary Examiner*—Sophia S. Chen
(74) *Attorney, Agent, or Firm*—Oblon, Spivak, McClelland, Maier & Neustadt, P.C.

(57) ABSTRACT

An image forming apparatus having a common sheet processing station with a sheet supply unit, at least one image forming unit which is detachably arranged with the common sheet processing station. The image forming unit forms images on a sheet carried from the common sheet processing station via a sheet carrying path. Many different image forming units may be utilized with the common sheet processing station.

17 Claims, 16 Drawing Sheets

IMAGE FORMING APPARATUS HAVING A COMMON SHEET PROCESSING STATION

CROSS REFERENCE TO RELATED APPLICATIONS

This document claims priority from and contains subject matter related to Japanese patent application numbers 11-177,692, 11-229,713, and 2000-173,374, the entire contents of which are incorporated herein by reference.

BACKGROUND OF THE INVENTION

1. Field of the Invention

This invention relates to an image forming apparatus, and particularly to the image forming apparatus with a sheet carrier unit and a sheet supply tray.

2. Description of the Related Art

In conventional image forming apparatus, an image forming device in a main body forms images on a recording sheet and the sheet is conveyed from an image transferring point to a tray or a sorter by a sheet carrying mechanism.

Now referring to FIG. 1(*a*), a conventional image forming apparatus is described.

An image forming device 10 generally includes a sheet supply tray 6 on a main body of the image forming apparatus 1. A sorter 2 is individually placed adjacent to the image forming apparatus 1.

In this type of the image forming apparatus, a paper chute of the sorter 2 is installed such that a route of the sheet conveying in the sorter 2 becomes the same route as that of the image forming device 10. Therefore, the paper chute of the sorter 2 is located on the same position as a paper chute of the image forming apparatus 1.

Recently, the demand for a small-footprint of the whole image forming apparatus is increasing. One of the conventional techniques to meet this demand is described in FIG. 1(*b*) wherein a sorter 2 is arranged on an upper part of the image forming apparatus 1.

In Japanese Laid Open patent application 10-115,959, another copying device is described. The copying device is constituted of the image forming device main body, an image reader, the carrying device for feeding the paper and a relay carrying unit, where the image forming device main body is attachable to one side surface of the carrying device for feeding the paper by a fixing means such as a screw. The image forming device main body is mainly provided with a developing device, a photoreceptor, a transfer belt, a cleaning device, an electrifying roller, and optical device and a fixing device 27' and an ejecting tray 5' is provided projectingly outside the side surface on a side where the optical device 26' is provided as shown in Figure.

Further, the relay carrying unit 6' is provided with a carrying path 61' in a connected state to an ejecting part, in the carrying device for feeding the paper 4' and further, a manual paper feeding part 62' below the carrying path 61'. The carrying path 61' of the relay carrying unit 6' is provided to connect to the carrying path 28' of a paper entrance part in the image forming device main body 2', in a nearly vertical direction.

On the other hand, there is a cartridge type image forming apparatus wherein detachable devices are put on and off the main body of the image forming apparatus.

And then, in Japanese Laid Open patent 03-275,376, unity image forming devices are laminated and are covered by the outer frame body.

However, the sheet processing station of each of the above conventional image forming apparatus is not common for different types of image forming apparatuses. That is, the sheet processing station can not be exchanged with different types of the image forming apparatus.

The image forming apparatus described in Japanese Laid Open patent 10-115,959 is capable of being a common paper supply tray and a paper feeding tray. But, this apparatus has not a sorter. If the sorter is connected to the apparatus, a footprint of the whole image forming apparatus becomes large.

SUMMARY OF THE INVENTION

The present invention has aspects to overcome the above problems encountered in the aforementioned art.

According to a first aspect of the present invention, an image forming apparatus, has a common sheet processing station with a sheet supply unit; and at least one image forming unit which is detachably arranged with the common sheet processing station, for forming images on a sheet carried from the common sheet processing station via the sheet carrying path.

According to a second aspect of the present invention, the common sheet processing station has a sheet supply unit which stocks recording sheets, a sheet ejecting tray and a sheet carrying path which carries the sheet from the sheet supply unit to the sheet ejecting tray.

According to a third aspect of the present invention, the common sheet processing station further has at least a sheet supply unit, a sheet sorter and a sheet ejecting tray.

BRIEF DESCRIPTION OF THE DRAWINGS

Other aspects and further features of the present invention will become apparent from the following detailed description when read in conjunction with the accompanying drawings, wherein.

DESCRIPTION OF THE PREFERRED EMBODIMENT

The present inventors identified that the sheet processing station does not need to be unique for types of image forming processes e.g. electrostatic image forming process, inkjet printing, thermal printing etc. It is preferable that the image forming devices should be exchangeable for the common sheet processing station according to user needs.

A description will now be given of preferred embodiments according to the present invention.

Explanation is omitted of the same devices, units or elements having the same function in each embodiment.

Figure 3A:
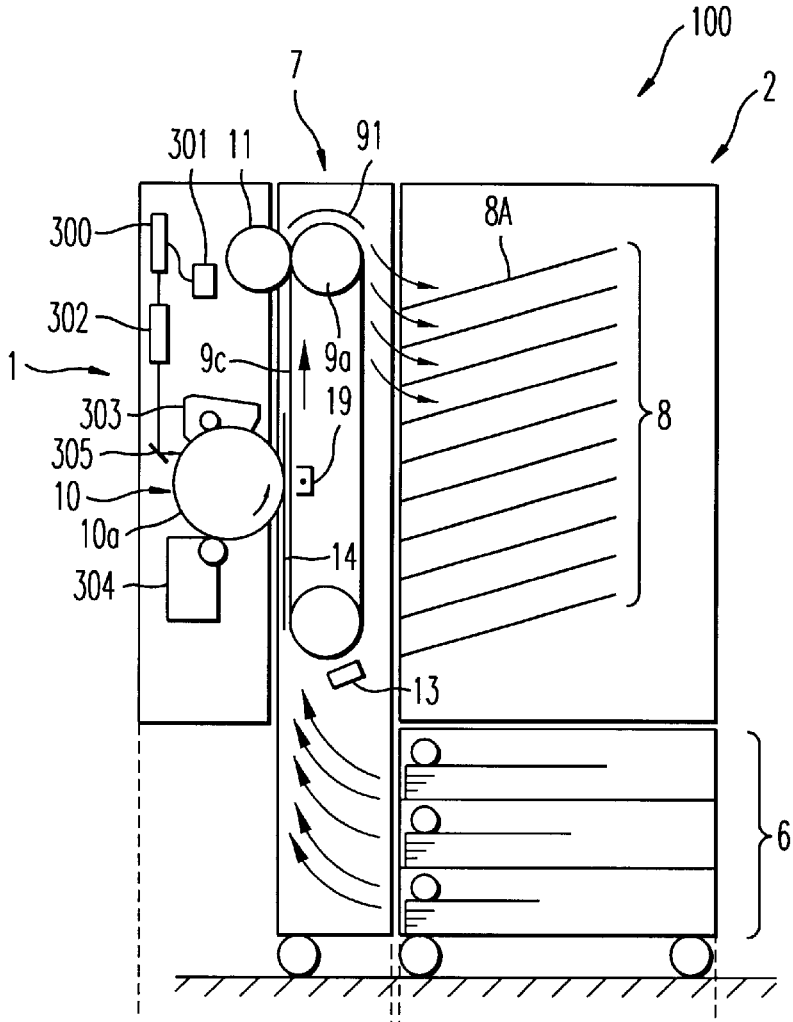
FIGS. 3(*a*) and (*b*) are views of a first embodiment according to the present invention.
Figure 3B:
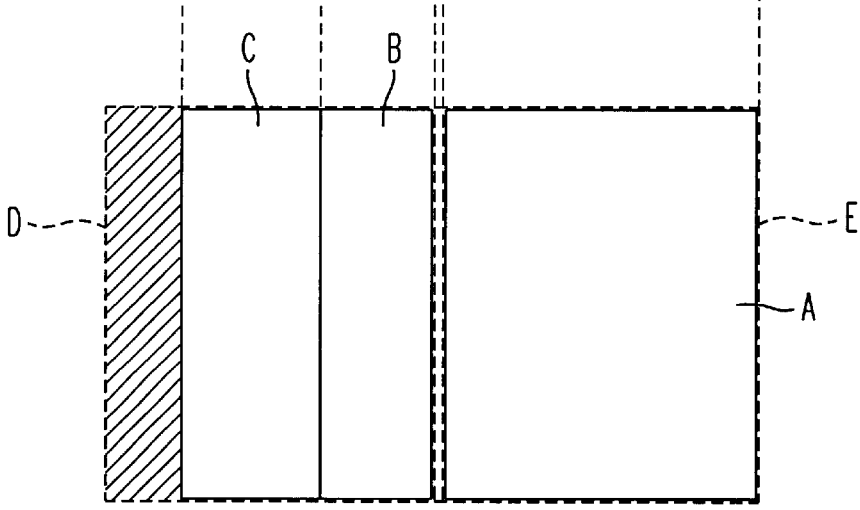

Now referring to FIG. 3, an image forming apparatus is made up of an image forming device 1, a sheet convey unit 7, and a sheet processing station 100. The sheet processing station 100 is further made up of sheet supply trays within a sheet supply unit 6 and a sorter 8, and the image forming device 1 is further made up of an optical system, a photoconductive drum 10, an electrostatic charger 303, a developing roller 304, a fixing roller 11 and a controller 301. Under control of the controller 301, a laser diode 300 irradiates laser beams to the polygon mirror 302 and the polygon mirror 302 scans the photoconductive drum 10 via the reflector mirror 305.

Electrostatic latent images are made on the photosensitive drum 10 which is driven to rotate and serves as an electrostatic carrier. The electrostatic charger 303 and the developing roller 304 are arranged around the photosensitive drum 10. The electrostatic charger 303 charges electrostatically a surface of the photosensitive drum 10 in a uniform condition. The developing unit supplies a toner and develops an electrostatic latent image formed on the surface of the photosensitive drum 10 into a visible image with a toner on the basis of a laser beam irradiated from the laser diode 300.

The transfer charger 19 in the sheet convey unit 7 transfers the visible image produced by the developing roller 304 to a paper that is supplied from the sheet supply unit 6 with a sheet convey belt 9*c* through the feeding paper path. The image-fixing roller 11 then fixes the visible toner image with roller 9*a*

The optical system is arranged in the image forming device 1 at a side opposite the photoconductive drum 10. The optical system is made up of a laser diode 300, a rotatable polygon mirror 302 having multiple reflecting surfaces and a reflector mirror 305 which guides laser beams in a predetermined direction on the photoconductive drum 10 to form an image thereon. The optical system irradiates the photoconductive drum 10 with laser beams corresponding to image data which is transmitted from the controller 301.

Under control of the controller 301, the image forming process is started and the laser beam is irradiated from the laser diode 300 based upon image data. An electrostatic latent image is formed on the surface of the photosensitive drum 10 by scanning of the laser beam via the polygon mirror 302 and the reflector mirror 305.

On the other hand, a sheet of paper is fed from one of the trays of the sheet supply unit 6. The paper is conveyed by a guide in the sheet convey unit 7. The toner image is transferred to the paper at the point between the photosensitive drum 10 and a transfer changer 19. The paper to which the toner image is transferred, is further conveyed and the toner image on the paper is fixed at a point between the fixing roller 11 and a roller 9*a*. The paper is guided by an upper guide 91 in the sheet convey unit 7 and finally fed to the tray 8A or one of the other trays of sorter 8. The sheet convey unit 7 further has a cooling device 13 which cools the conveying belt 9*c*.

Figure 1A:
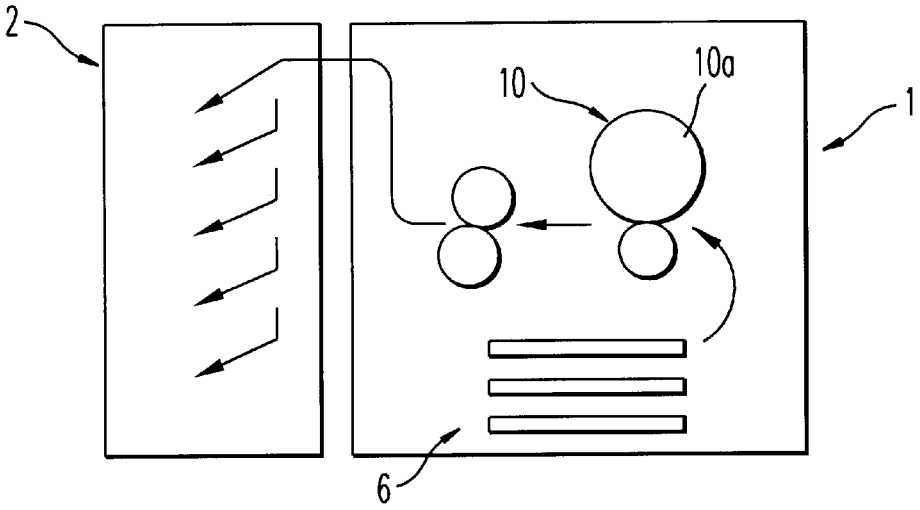
FIGS. 1(*a*) and (*b*) are conceptional views of structure of the conventional image forming apparatus.
Figure 1B:
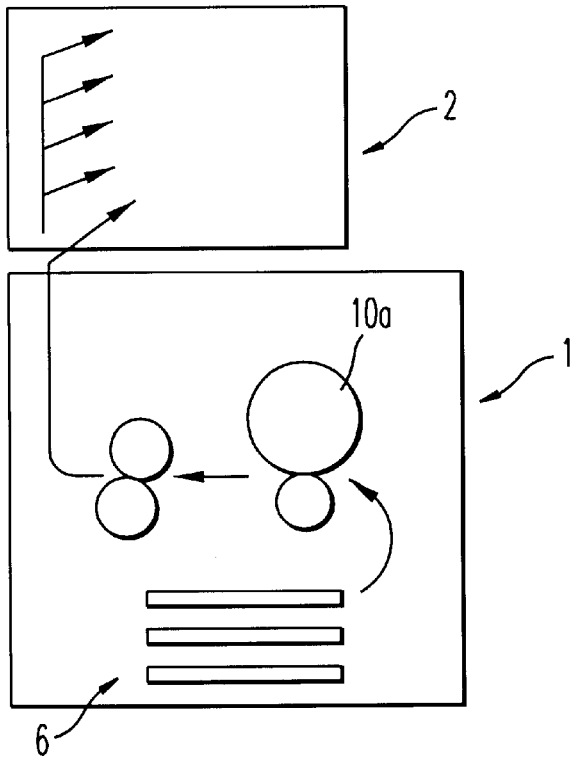
FIG. 1b PRIOR ART
Figure 2:
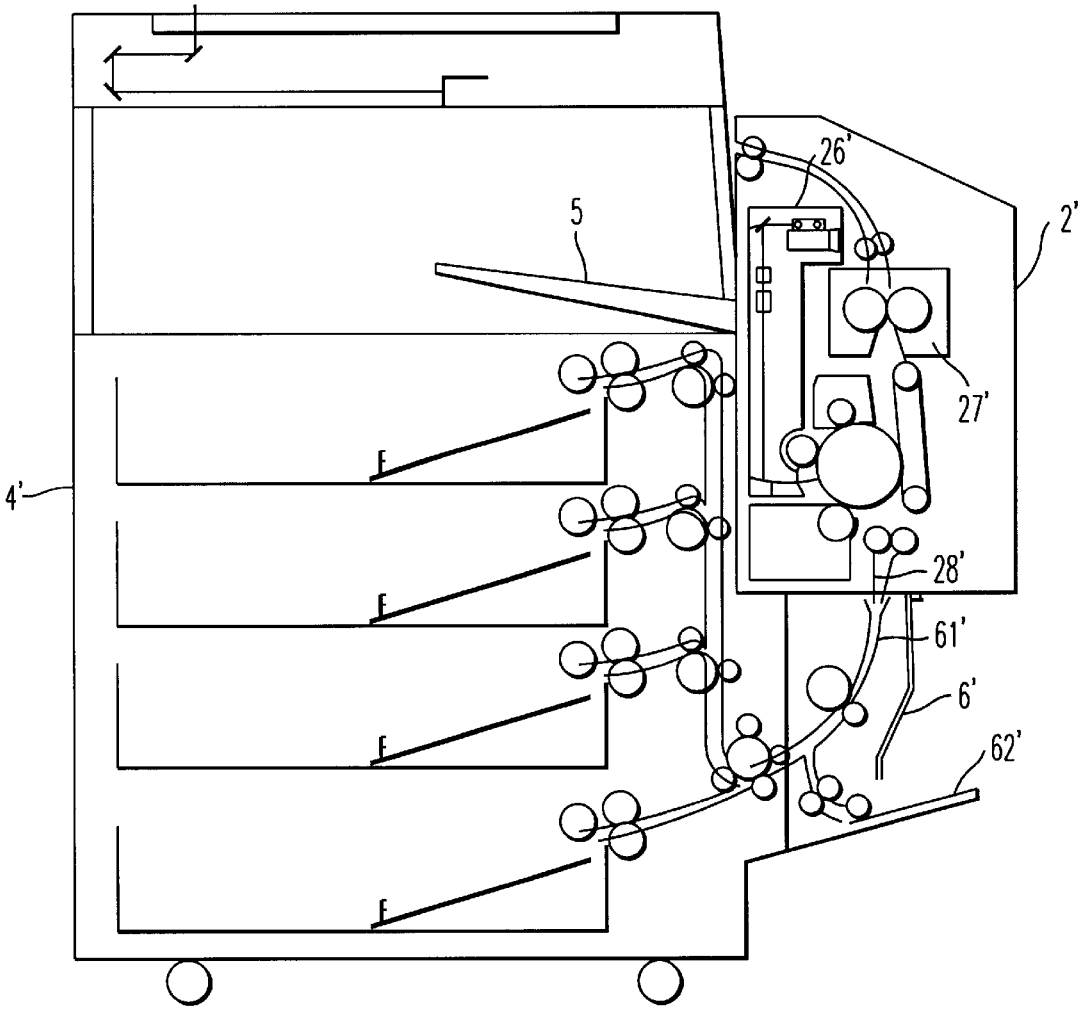
FIG. 2 PRIOR ART
FIG. 2 is a cross-sectional view of the prior art.

Now referring to FIG. 3(*b*), area D shows a footprint of the conventional image forming apparatus which has a sorter. The total area of A, B and C shows the image forming apparatus according to the present invention. It is seen that the footprint of the image forming apparatus becomes smaller than one of the conventional image forming apparatus. Furthermore, the sorter is not located on the top of the image forming apparatus. Therefore, the height of the image forming apparatus is also shorter than one of the image forming apparatus as shown FIG. 1(*b*).

Figure 4:
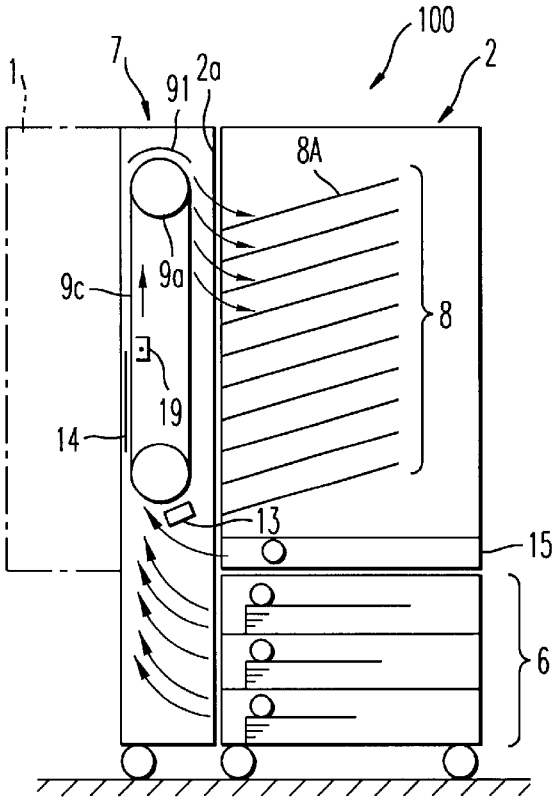
FIG. 4 is a cross-sectional view of a second embodiment according to the present invention.

Now referring to FIG. 4, a second embodiment is described. The sheet processing station according to the second embodiment has a sheet inserting tray 15. When the user want to use a special paper or OHP films, the user is capable of inserting the sheet at the sheet inserting tray 15. The image forming process is the same as the first embodiment. Moreover, the other devices have a same structure as the above first embodiment, so explanation is omitted.

Figure 5:
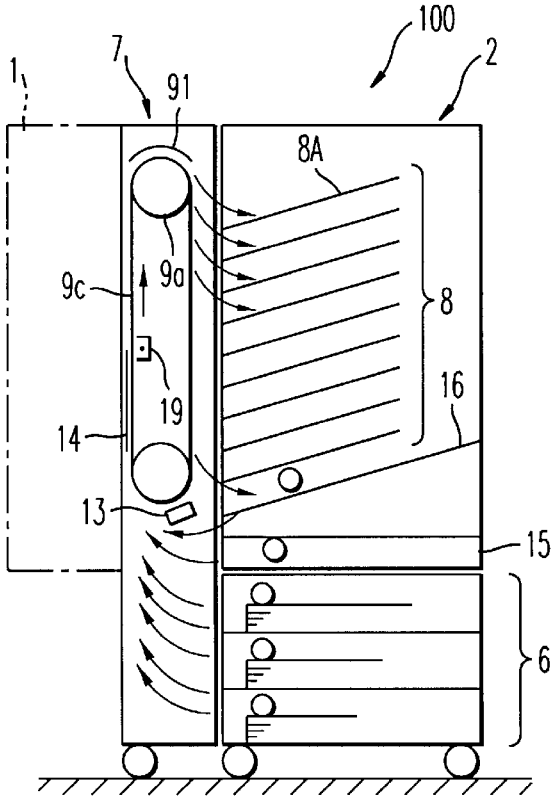
FIG. 5 is a cross-sectional view of a third embodiment according to the present invention.

Referring to FIG. 5, a third embodiment is described. The sheet processing station 100 has a sheet inserting tray 15 and a sheet reverse tray 16 for producing two sided copies. The sheet inserting tray 15 is the same of the second embodiment. Therefore, explanation is omitted.

A sheet of paper is fed from one of the trays of the sheet supply unit 6 and the image is formed at a first surface of the paper. The paper is conveyed to a chute of the reverse tray 16 by a guide in the sheet convey unit 7. When the paper is stored into the reverse tray 16, the image formed surface of the paper faces upwardly. In a next step, the paper is fed to the image forming device from the reverse tray 16 by a guide in the sheet convey unit 7. A toner image is transferred to an underside of the image formed side of the paper thereby producing a two-sided copy.

Figure 6:
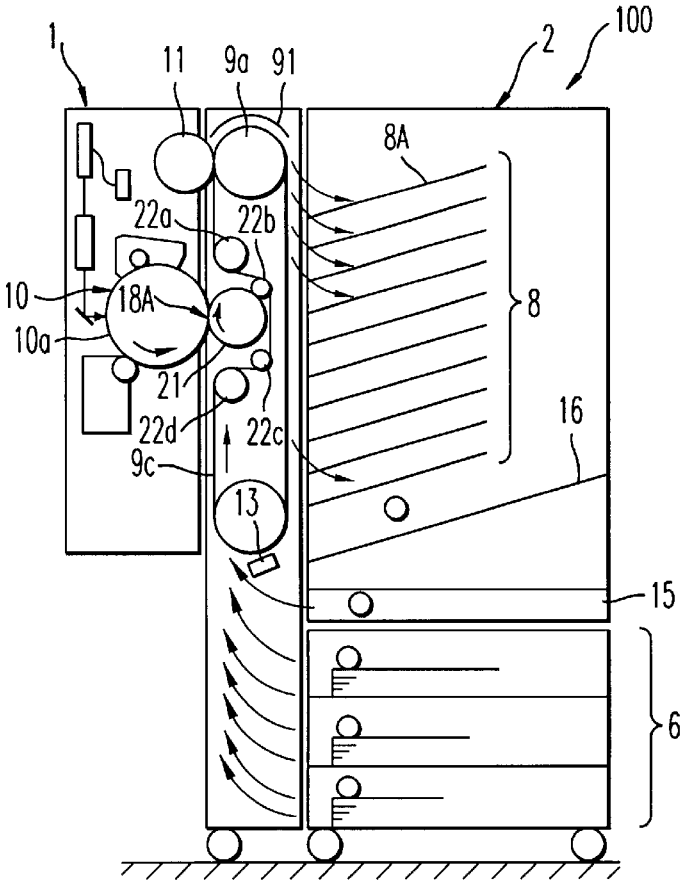
FIG. 6 is a cross-sectional view of a fourth embodiment according to the present invention.
Figure 7:
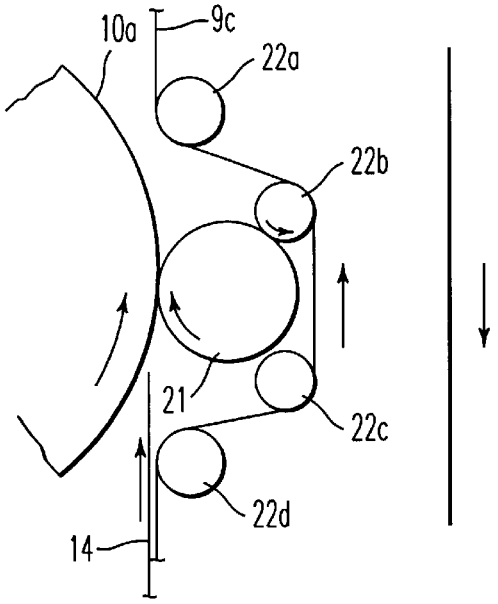
FIG. 7 is a detailed structure of a transfer roller portion of the fourth embodiment.

Now referring to FIGS. 6 and 7, a fourth embodiment is described. An image forming device and a sheet processing station are the same as the above embodiments, so explanation is omitted.

Rollers 22*a*, 22*b*, 22*c* and 22*d* make a recessed area in the convey belt 9*c*. A transfer roller 21 is located on the above recessed area. When the paper feeds from the sheet supply unit 6, the paper separates from the belt 9*c* at the roller 22*d*. The paper is inserted into the image transfer point between the photoconductive drum 10 and the transfer roller 21 where a toner image is formed on the paper. The paper on which the toner images are formed merges with the belt 9*c* at the roller 22*a*.

Figure 8:
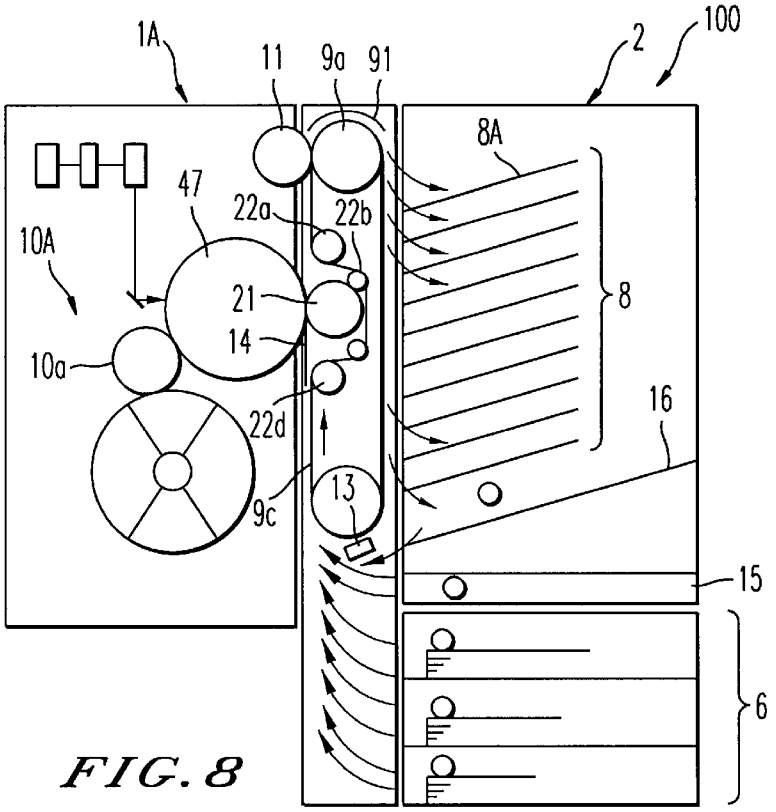
FIG. 8 is a cross-sectional view of a fifth embodiment according to the present invention.

Referring to FIG. 8, a fifth embodiment is described. The sheet convey unit and the sheet processing station are the same as the fourth embodiment, so explanation is omitted.

In this embodiment, a full color revolver type image forming device 1A is attached on the sheet convey unit. Under control of a controller, a revolver type developer rotates, each color toner image is formed on a photoconductive drum 10*a*. Each color toner image is transferred to an intermediate transfer drum 47. The full color toner image is then transferred to the paper at the point between the intermediate transfer drum 47 and the transfer roller 21.

Figure 9:
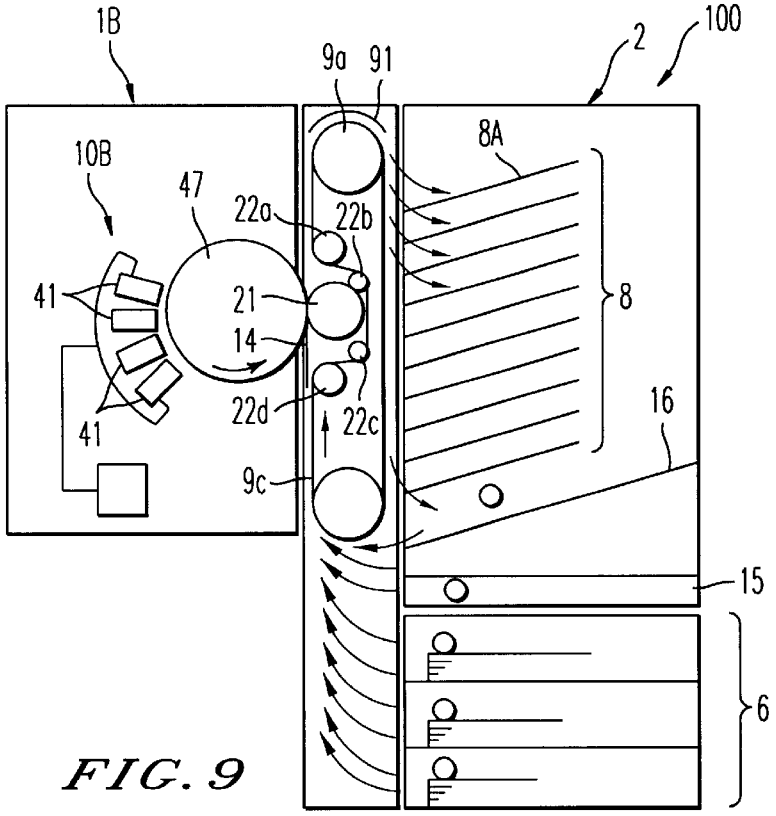
FIG. 9 is a cross-sectional view of a sixth embodiment according to the present invention.

Now referring to FIG. 9, a sixth embodiment is described. In the sixth embodiment, an inkjet type image forming device 1B is attached on the sheet convey unit. The other devices are capable of operating the same as described in the fifth embodiment. Under control of the controller, each head 41 ejects ink drops to the intermediate transfer drum 47. When a full color image is formed on the intermediate transfer drum 47, the full color image is transferred to the paper at the point between the intermediate transfer drum 47 and the transfer drum 21.

Figure 10:
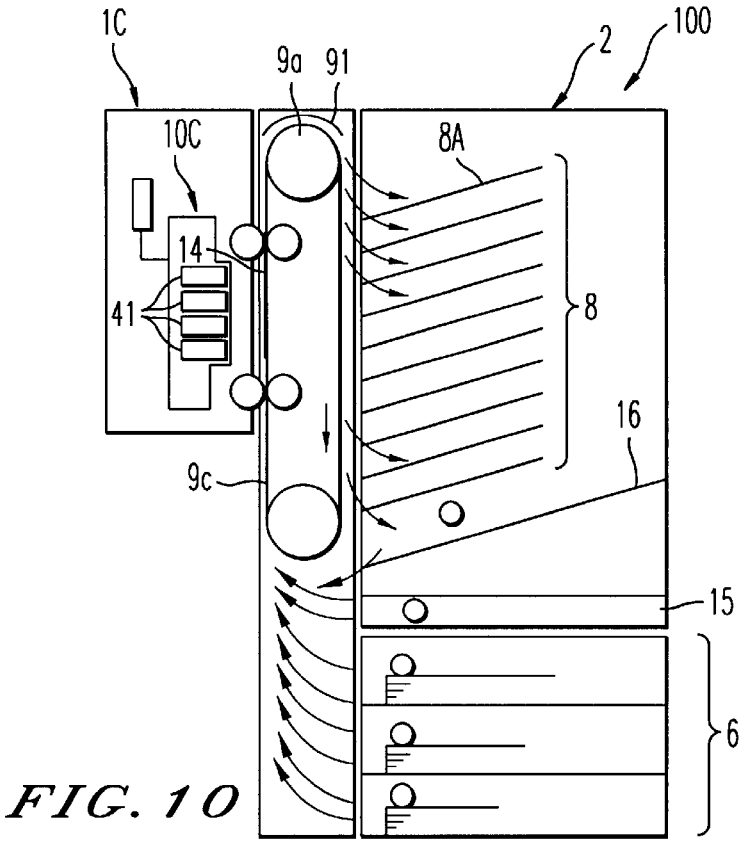
FIG. 10 is a cross-sectional view of a seventh embodiment according to the present invention.

Referring to FIG. 10, another embodiment of an inkjet type image forming device 1C is described. In this embodiment, under control of the controller, each head 41 directly ejects ink drops to the paper on the belt 9*c*.

Figure 11:
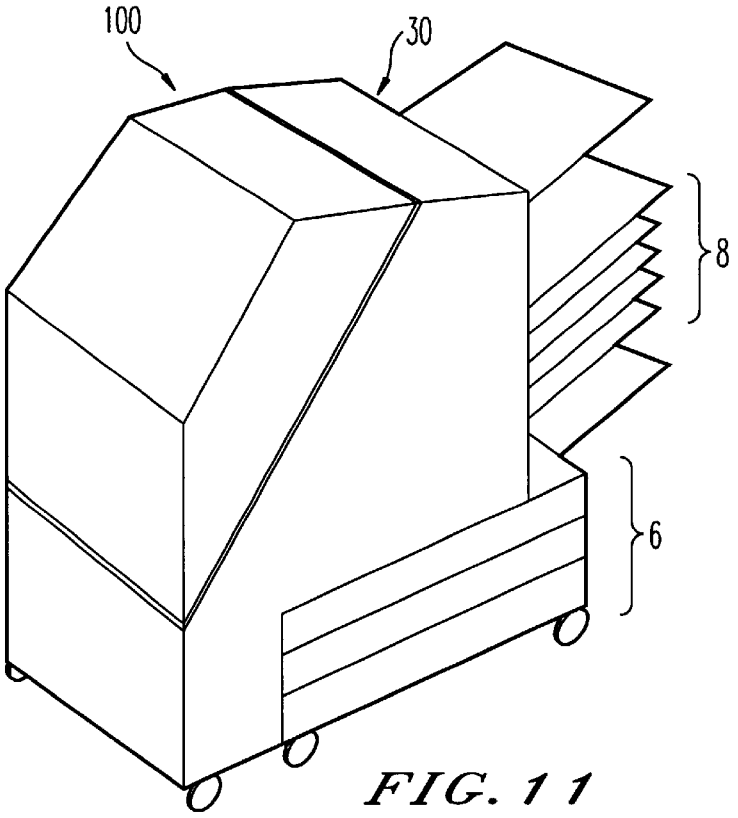
FIG. 11 is a perspective view of the image forming apparatus of an eighth embodiment according to the present invention.
Figure 12:
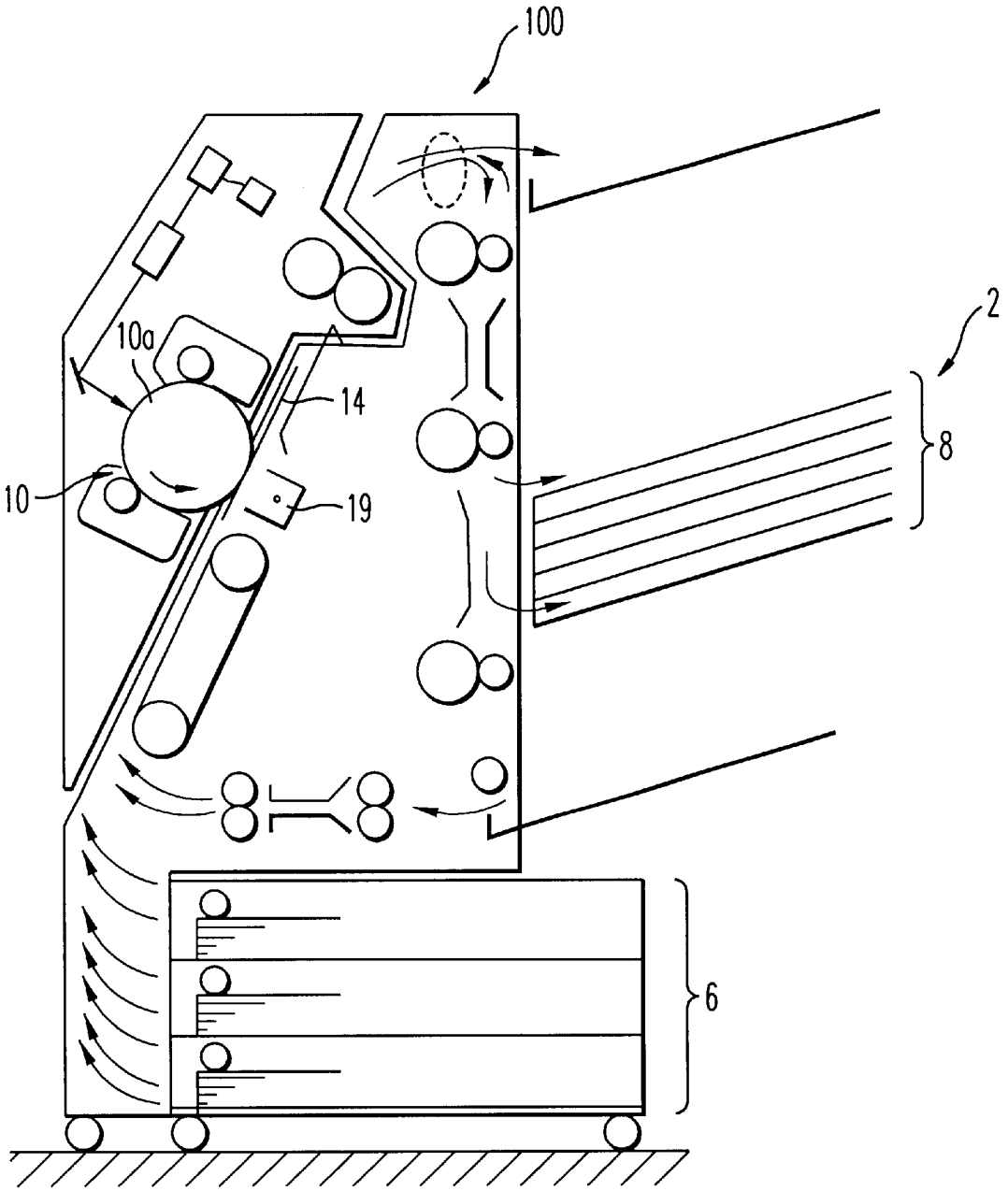
FIG. 12 is a cross-sectional view of the eighth embodiment according to the present invention.

Now referring to FIG. 11, a perspective view of another embodiment is described. The function of each device is the same as the embodiment as shown FIG. 4. However, in this embodiment, an image forming device which has a skewed shape is located on the top of the sheet processing station in order to reduce area of the footprint of the whole image forming apparatus. The detail structure of this embodiment is described in FIG. 12.

Figure 13A:
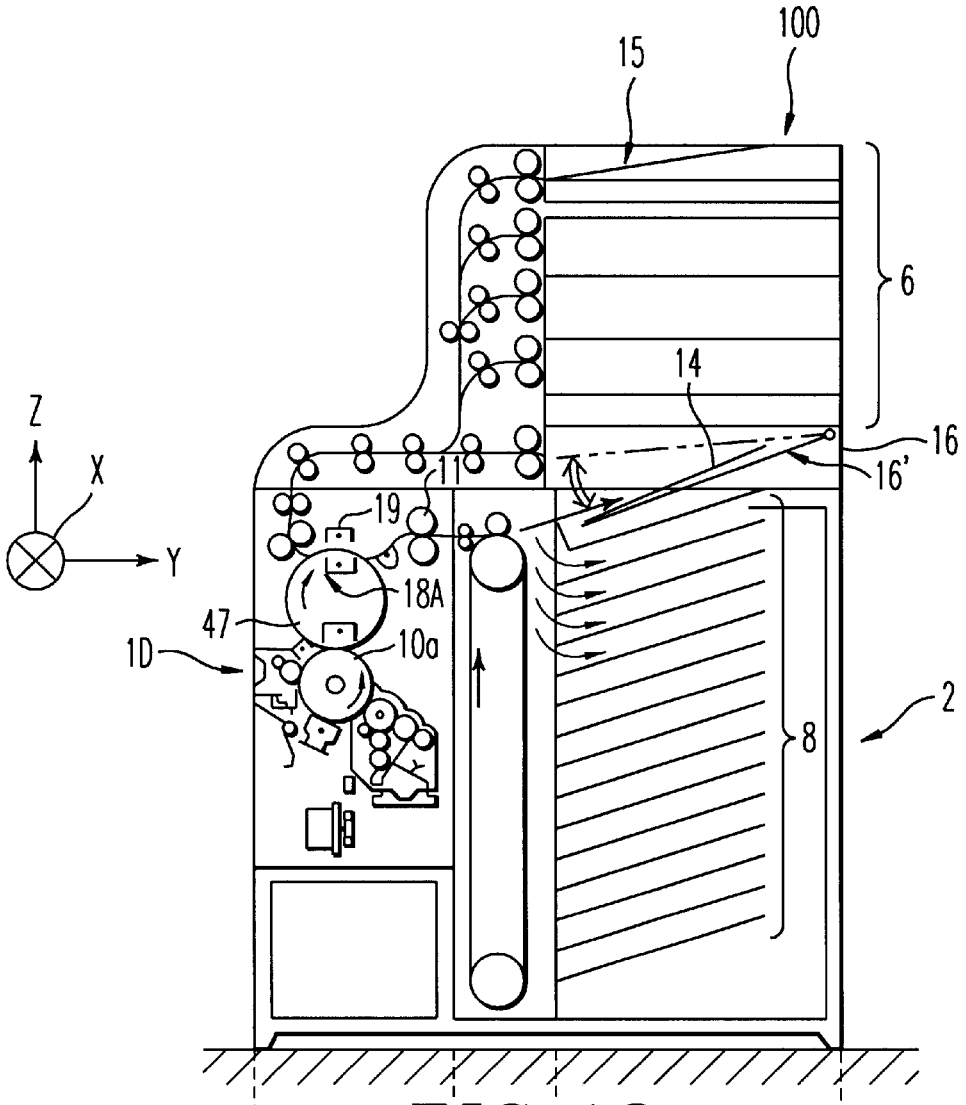
FIGS. 13(*a*) and (*b*) are views of a ninth embodiment according to the present invention.
Figure 13B:
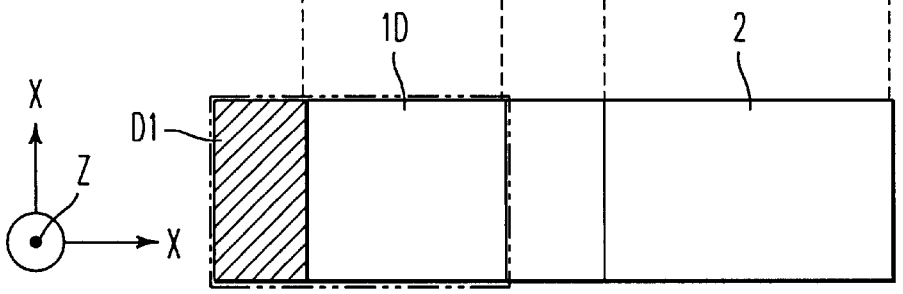
Figure 14:
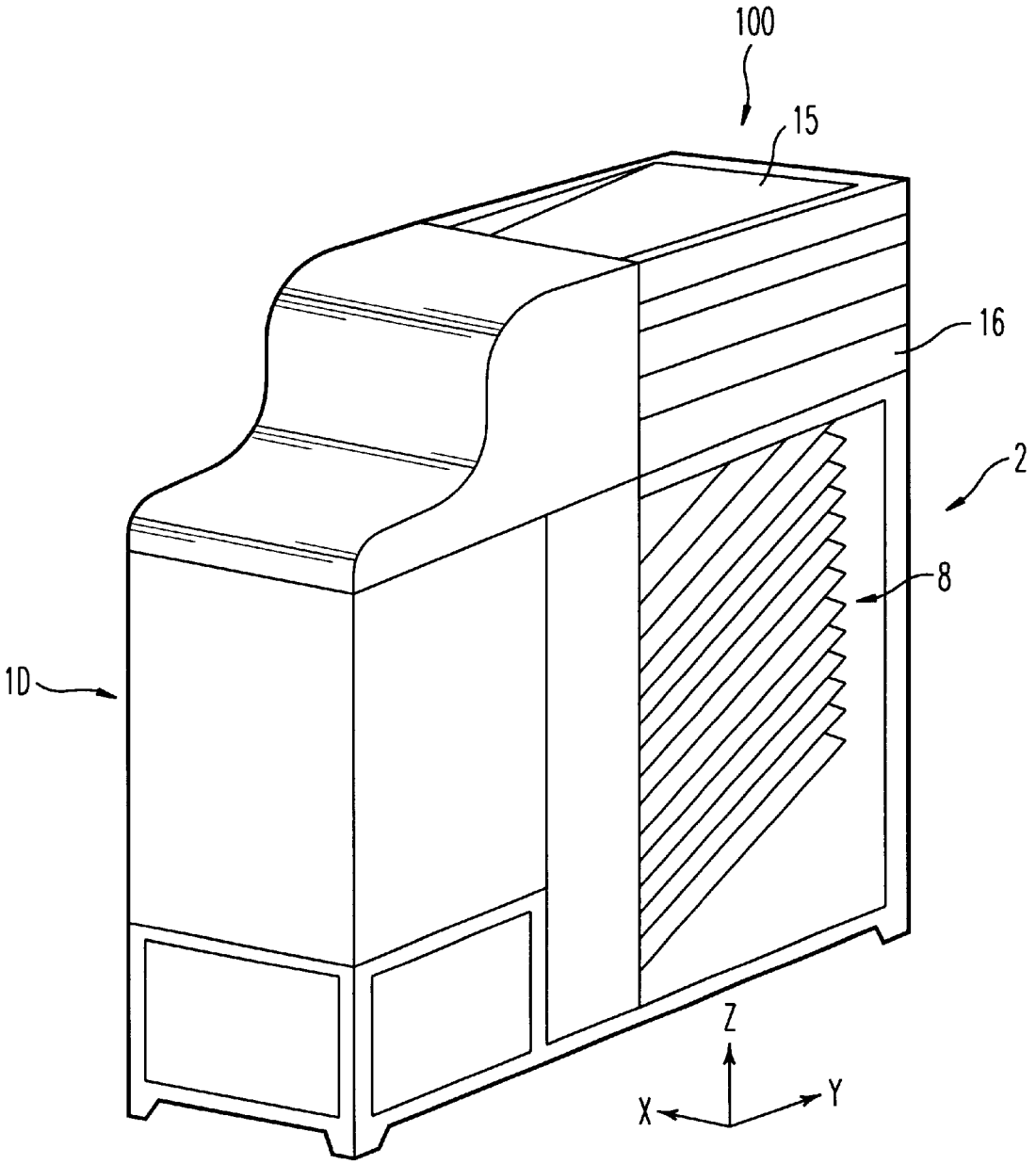
FIG. 14 is a perspective view of the image forming apparatus of the ninth embodiment according to the present invention.
Figure 15:
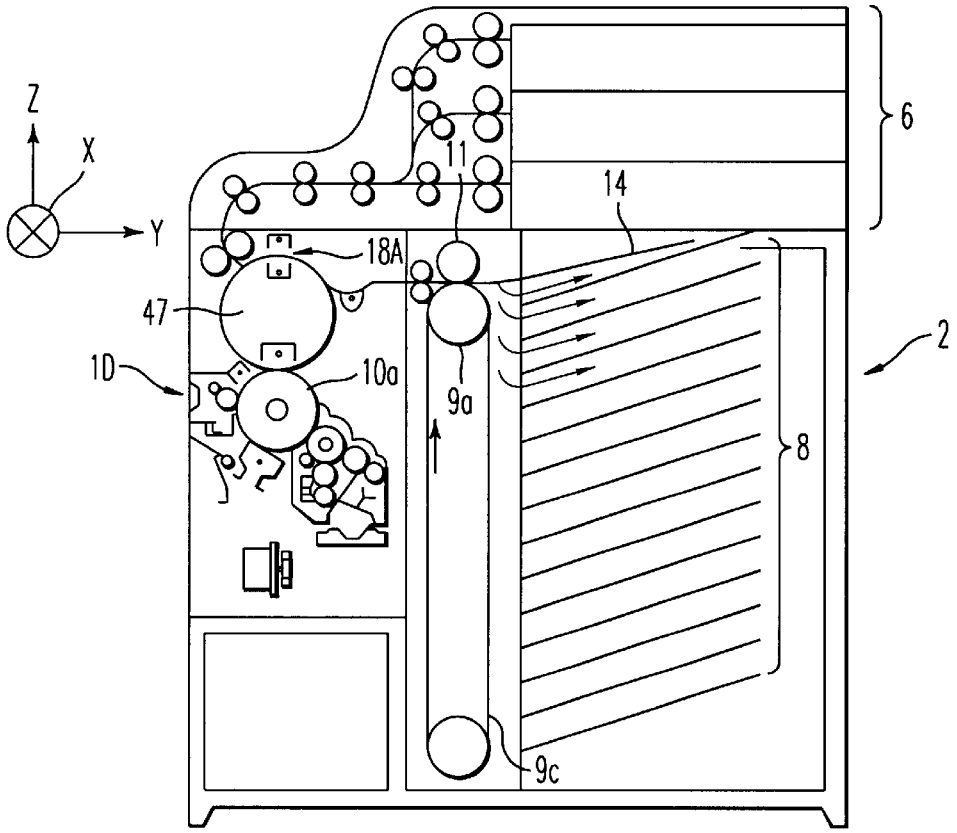
FIG. 15 is a cross-sectional view of the ninth embodiment according to the present invention.

Now referring to FIGS. 13, 14 and 15, the eighth embodiment is described. A sheet supply unit 6 and a sheet insert tray 15 are located on the upper part of a sorter 2. A paper that is fed from one of the trays of the sheet supply unit 6 is carried into an image forming device. Images on an intermediate transfer drum 47 are transferred to the paper at a point between the intermediate transfer drum 47 and a transfer charger 18A, and then the paper is fed to the sorter 2, as shown by the direction arrow in FIG. 13, the embodiment shown therein may also have a sheet reversing tray 160 having a movable portion 16 that allows the image forming unit to produce an image on both sides of paper 14.

Figure 16:
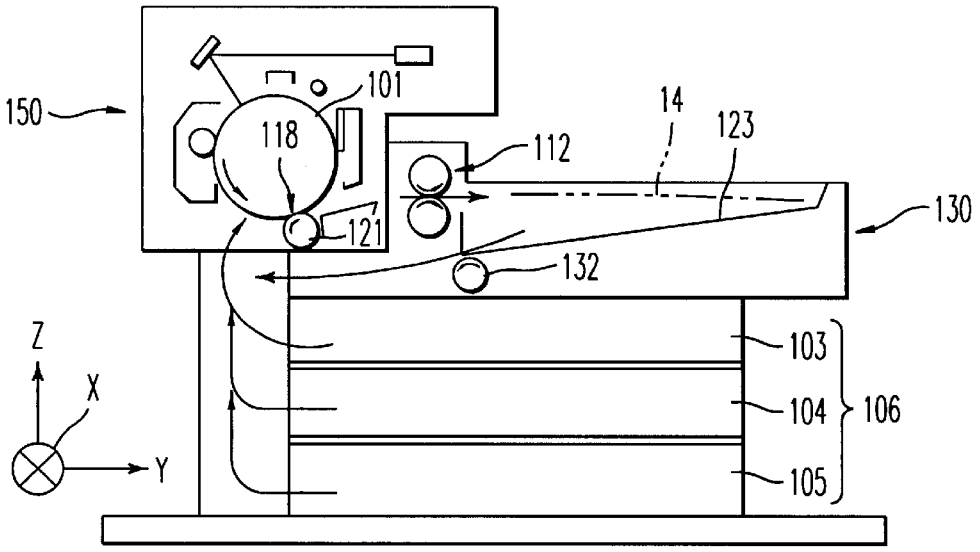
FIG. 16 is a cross-sectional view of a tenth embodiment according to the present invention.
Figure 17:
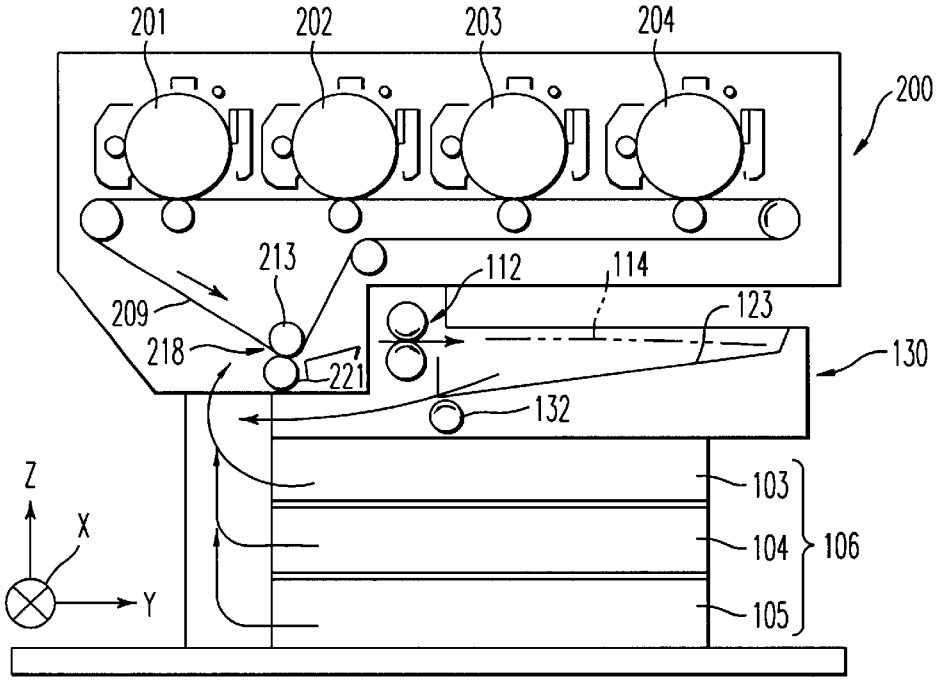
FIG. 17 is a cross-sectional view of a tenth embodiment according to the present invention.
Figure 18:
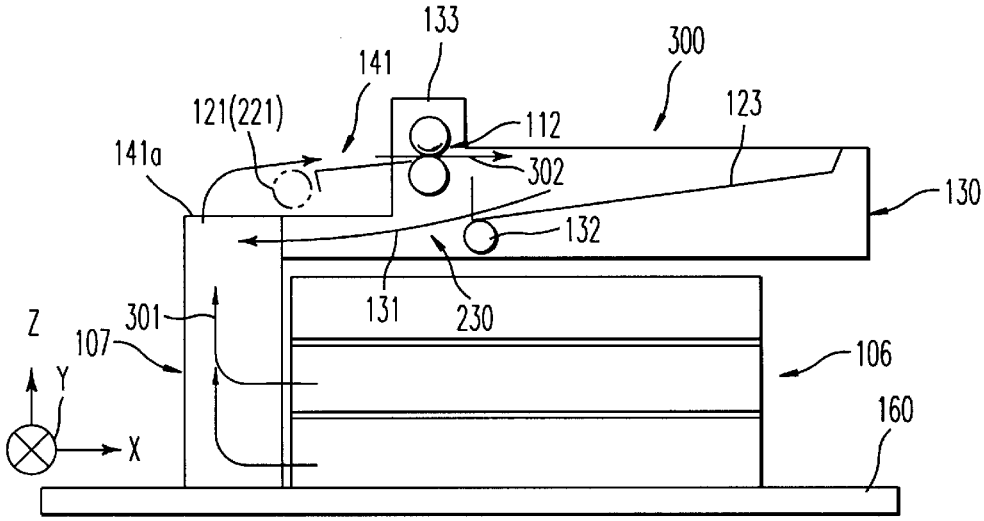
FIG. 18 is a cross-sectional view of a sheet processing station of the tenth embodiment according to the present invention.

Now referring to FIGS. 16, 17 and 18, a ninth embodiment is described. A common sheet processing station is made up of a sheet supply unit 106 which has plural sheet tray 103, 104 and 105, a sheet reverse unit 130 and a fixing device 112. In FIG. 16, the single color type image forming device is employed. The image forming device is an exchangeable image forming device. When a paper is fed from one of the sheet supply tray 103, 104 and 105 in the sheet supply unit 106, the paper is guided into the image forming device 150. The toner images which is formed on a photoconductive drum 101 is transferred to the paper at a point between the photoconductive drum 101 and a transfer drum 121. The paper is then fed into the sheet processing station again, the toner images on the paper is fixed by the fixing device 112.

When the user selects double-sided printing mode, a left side of the sheet tray 123 moves down, a roller 132 feeds the paper having an image formed on one side thereof to the image forming device again by a rotation of the roller 132. The image forming device then forms an image on the blank side of the paper to form a double sided copy.

Referring to FIG. 17, in this embodiment, a full color image forming device is selected instead of the above single color image forming device described in FIG. 16. At this time, the sheet processing station 130 is capable of being common.

The full color image forming device 200 has a set of four photoconductive drums 201–204, a developer, a charger, a cleaner, and a transfer charger for Yellow, Magenta, Cyan, and Black each.

Each color image on the photoconductive drums is transferred to an intermediate transfer belt 209. The full color image is then simultaneously transferred to the paper at a point between a roller 213 and a roller 221. The paper then is fed into the sheet processing station again, the full color toner images is fixed by the fixing roller 112.

When the user selects double-sided printing mode, a left side of the sheet tray 123 moves down, a roller 132 feeds the paper to the image forming device again by a rotation of the roller 132. The image forming device then forms an image on the blank side of the paper to form a double sided copy.

The above described sheet processing station 130 feeds the paper from the sheet supply unit to the image forming device, receives the paper which the toner images are formed, and fixes the toner images on the paper. When the user needs the double-sides printing, the sheet processing station feeds the paper to the image forming device again. Moreover, as seen in FIG. 18, the sheet processing station 130 may be used with either the single color image forming device 150 of FIG. 16 or the full color image forming device 200 of FIG. 17.

Figure 19:
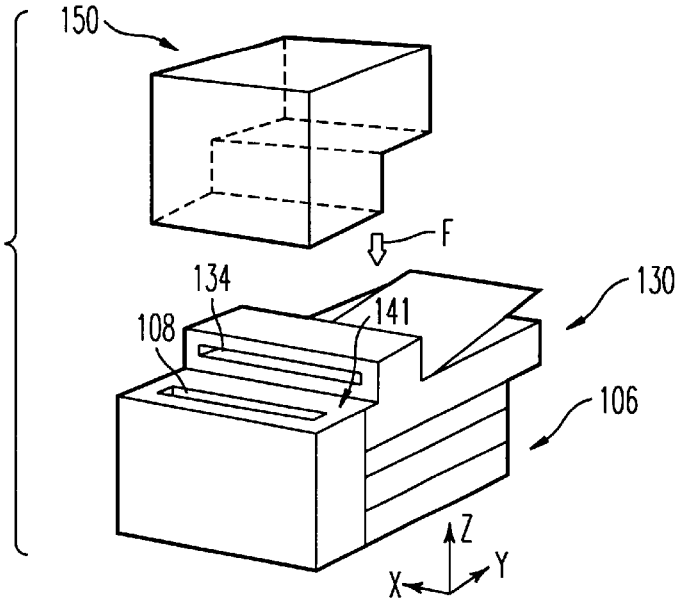
FIG. 19 is a perspective view of a connection between an image forming device and a sheet processing station of the tenth embodiment.
Figure 20:
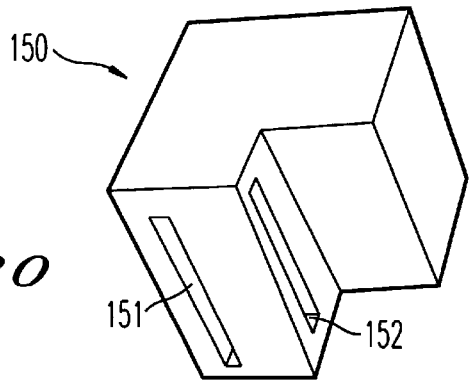
FIG. 20 is a perspective view of the image forming device of the tenth embodiment.

Referring to FIGS. 19 and 20, a type of sheet processing station 130 that accepts image forming devices 150 having plural image forming process is shown. The positions of the paper ejecting chute 108 and the chute 134 of the sheet processing station correspond with the chute 151 and the chute 152 of the image forming device respectively. Therefore, the sheet processing station 130 according to the present invention is capable of employing every type of image forming process.

Figure 21:
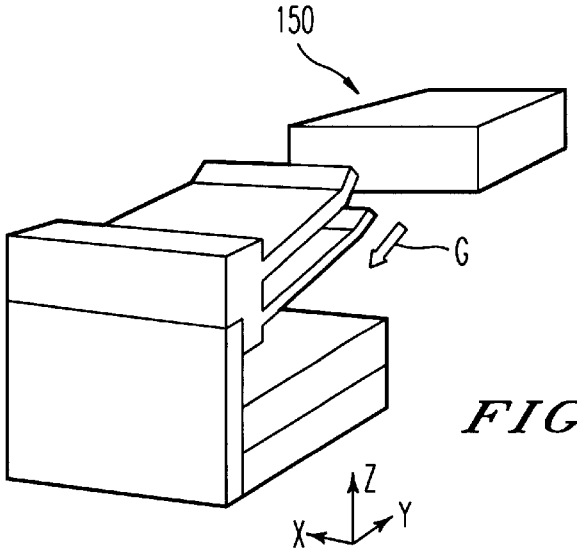
FIG. 21 is a perspective view of a connection between an image forming device and a sheet processing station of the eleventh embodiment.
Figure 22:
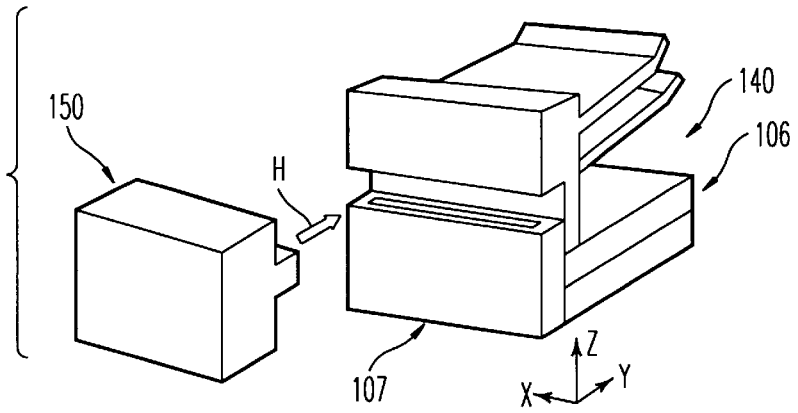
FIG. 22 is a perspective view of a connection between an image forming device and a sheet processing station of the twelfth embodiment.

A connecting position between the image forming device and the sheet processing station is flexible. Thus, referring to FIG. 21, it is seen that the image forming device connects with an inside of the sheet processing station. Furthermore, the image forming device is capable of connecting with the outside of the sheet processing station as seen in FIG. 22.

Figure 23:
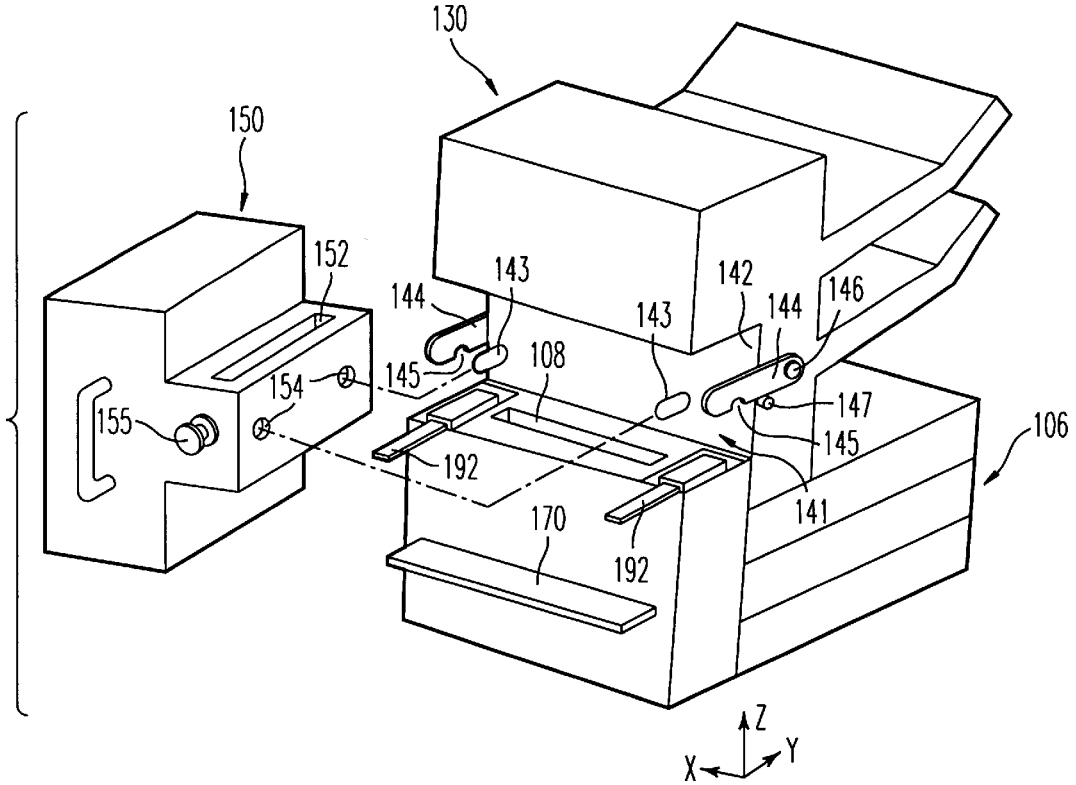
FIG. 23 is a perspective view of a detailed connection between an image forming device and a sheet processing station of the twelfth embodiment.

Now referring to FIG. 23, the detail connection of the image forming device and the sheet processing station is described.

Figure 24:
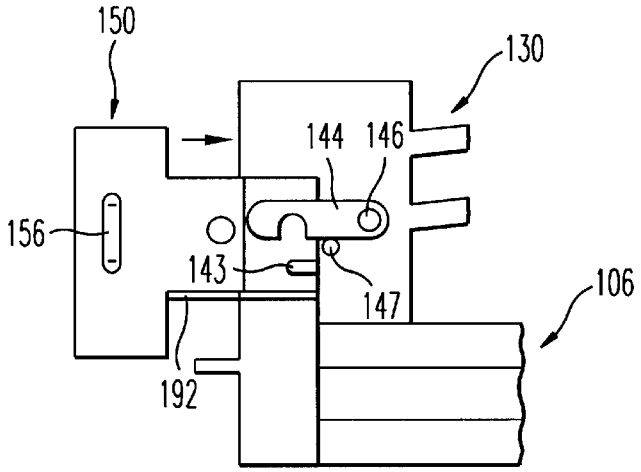
FIG. 24 is a cross-sectional view of a connection between an image forming device and a sheet processing station of the twelfth embodiment.

The image forming device 150A has a pair of protrusions 155 and a pair of holes 154. The sheet processing station 130A has also a pair of hooks 144, a pair of sidebars 192 and a pair of adjustment protrusions 143. When the image forming device 150A is joined with the sheet processing station 130A, the image forming device 150A is placed put on the sidebars 192, and slid into the sheet processing station 130A. The pair of adjustment protrusions 143 are thereby inserted into the pair of holes 154 as shown FIG. 24. In this situation, the hooks 144 is located on upper position. The position of the image forming device is adjusted so as to flush against the sheet processing station 130A.

Figure 25:
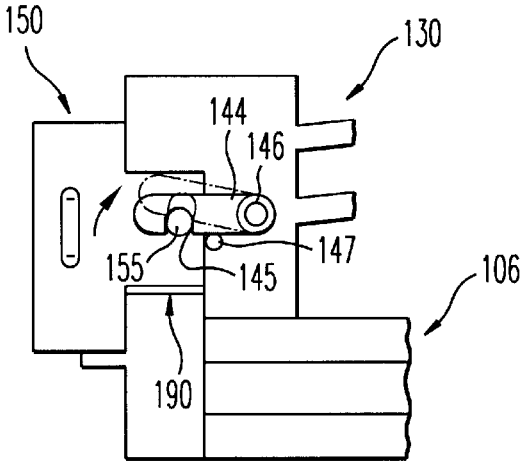
FIG. 25 is a cross-sectional view of a connection between an image forming device and a sheet processing station of the twelfth embodiment.
Figure 26:
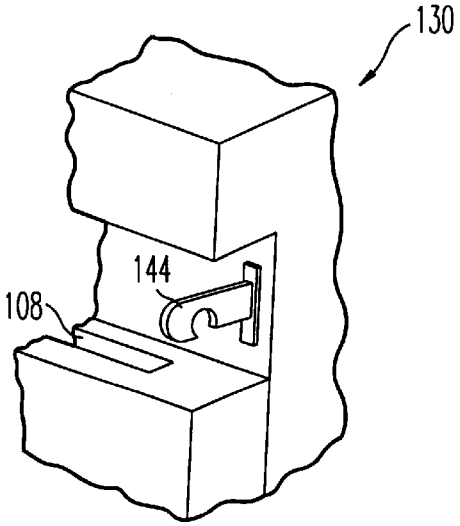
FIG. 26 is a perspective view of a connecting hook of the twelfth embodiment.

When the position of the image forming device is so adjusted, the pair of hooks 144 rotate around respective centers 146 in a downward direction and notches 145 contact and cover protrusions 155 as shown in FIG. 25. The hooks 144 are also capable of arranging inside of the sheet processing station as shown FIG. 26.

Figure 27:
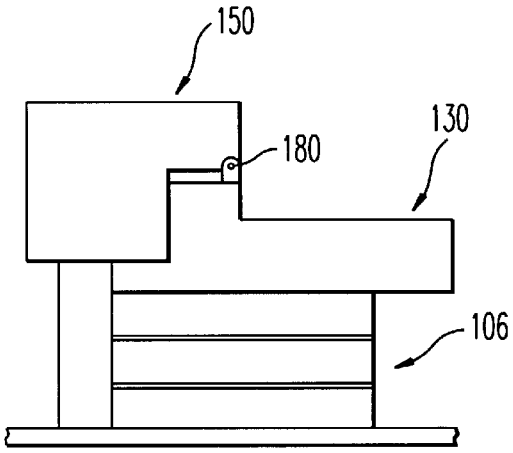
FIG. 27 is a cross-sectional view of a connection between an image forming device and a sheet processing station of the thirteenth embodiment.
Figure 28:
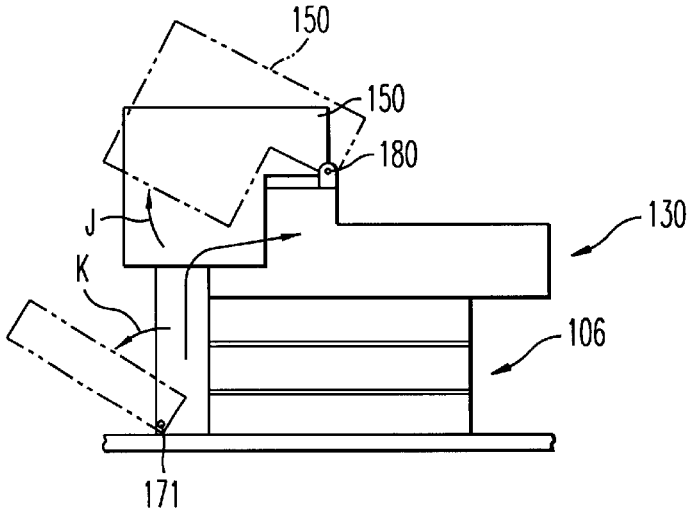
FIG. 28 is a cross-sectional view of a connection between an image forming device and a sheet processing station of the thirteenth embodiment.

Now referring to FIGS. 27 and 28, another embodiment is described. In this embodiment, the image forming device 150 is set by rotating around center 180 which is arranged on the top of the sheet processing station 130. When the image forming device is set, the corner of the image forming device is locked and the image forming device rotates downward around the center 180.

As shown FIG. 28, the sheet processing station is also capable of employing a structure in which the sheet convey unit rotates around a lower comer 171 into an opening between the sheet convey unit and the sheet supply unit.

Figure 29:
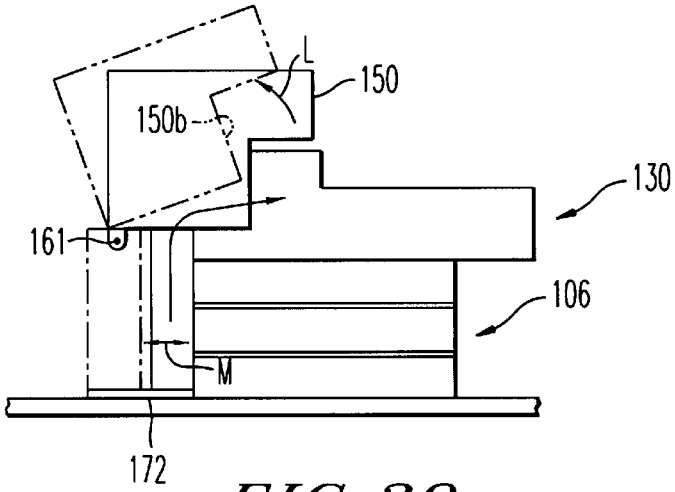
FIG. 29 is a cross-sectional view of a connection between an image forming device and a sheet processing station of the fourteenth embodiment.

Now referring to FIG. 29, there is shown another mechanism of connecting the image forming device and the sheet convey unit. The image forming device is locked at a lower corner with the sheet convey unit and is rotatable around the corner. In the case that the image forming device and the sheet convey unit separate from the sheet processing station, the image forming device and the sheet convey unit simultaneously slide by a sidebar 172 away from the sheet processing station while the image forming device opens up by rotating around pivot point 161.

When the image forming device and the sheet convey units are connected, the reverse process of the above is carried out.

Obviously, numerous modifications and variations of the present invention are possible in light of the above teachings. It is therefore to be understood that within the scope of the appended claims, the invention may be practiced otherwise than as specifically described herein.

What is claimed is:

1. An image forming apparatus, comprising:

a common sheet processing station having a sheet supply unit and configured to process sheets for any one of a plurality of different image forming units; and one of said plurality of image forming units detachably joined with said common sheet processing station via a sheet-carrying path.

2. The image forming apparatus according to claim 1, wherein said sheet supply unit is configured to stock recording sheets and said common sheet processing station comprises:

a sheet ejecting tray, wherein said sheet-carrying path is configured to carry the sheet from the sheet supply unit to the sheet-ejecting tray.

3. The image forming apparatus according to claim 2, wherein said one of said plurality of image forming units is located on the sheet-carrying path.

4. The image forming apparatus according to claim 1, wherein said common sheet processing station further comprising:

a sheet sorter; and a sheet ejecting tray.

5. A common sheet processing station, comprising:

a sheet supply unit configured to hold sheets of paper; and a sheet sorter configured to sort sheets of paper, wherein said sheet supply unit and said sheet sorter are configured to attach to a sheet conveying unit which is configured to convey said sheets of paper between said sheet processing station and any one of a plurality of different image forming devices.

6. The common sheet processing station as claimed in claim 5, further comprising a manual sheet insert tray.

7. The common sheet processing station as claimed in claim 5, further comprising a sheet reversing tray.

8. An image forming apparatus comprising:

a sheet processing station;

a sheet conveying unit connected to said sheet processing station and configured to convey sheets of paper between said sheet processing station and any one of a plurality of different image forming devices; and an image forming unit detach ably connected to said sheet conveying unit.

9. The image forming apparatus as claimed in claim 8, wherein said sheet processing station comprises:

a sheet supply unit;

a sheet sorter;

a manual sheet insert tray; and a sheet reversing tray.

10. The image forming apparatus as claimed in claim 9, wherein said sheet supply unit is arranged above said sheet sorter in a direction of gravity.

11. The image forming apparatus as claimed in claim 10, wherein said sheet reversing tray comprises a paper guide movable between a feeding portion of an image forming device and a feeding portion of the sheet sorter.

12. The image forming apparatus as claimed in claim 8, wherein said sheet conveying unit further comprises:

a conveying belt configured in a loop to convey said sheets of paper; and a transfer roller positioned within a recessed portion of said loop of said sheet conveying belt.

13. The image forming apparatus as claimed in claim 8, wherein said image forming unit comprises a single color image forming unit.

14. The image forming apparatus as claimed in claim 8, wherein said image forming unit comprises a full color revolving image forming unit.

15. The image forming apparatus as claimed in claim 8, wherein said image forming unit comprises an inkjet image forming unit.

16. The image forming apparatus as claimed in claim 8, wherein said image forming unit is located on top of said sheet processing station in a direction of gravity and has a skewed shape configured to reduce the footprint of the image forming apparatus.

17. An image forming device comprising:

means for processing sheets of paper used in an image forming device;

means for conveying said sheets of paper in said image forming device;

means for forming images on said sheets of paper; and means for detachably connecting said means for forming images to said image forming device, wherein any one of a plurality of different means for forming images may be connected and used with said means for processing sheets and said means for conveying sheets.

* * * * *